United States Patent [19]

Schmidt

[11] 3,935,598

[45] Feb. 3, 1976

[54] FLAPPER FLUSH VALVE

[76] Inventor: Albert Leo Schmidt, 1000 W. Eva Lane, Mount Prospect, Ill. 60070

[22] Filed: July 8, 1974

[21] Appl. No.: 486,364

[52] U.S. Cl. ..... 4/57 P; 4/67 A

[51] Int. Cl.[2] ..... E03D 1/34

[58] Field of Search ..... 4/27–29, 34, 4/37, 52, 55–58, 65, 67 A, 67 R

[56] References Cited

UNITED STATES PATENTS

| | | | |
|---|---|---|---|
| 3,324,482 | 6/1967 | Wustner | 4/57 R |
| 3,365,730 | 1/1968 | Chiappetta | 4/57 R X |
| 3,590,395 | 7/1971 | Wustner | 4/56 |
| 3,733,618 | 5/1973 | Wiegand | 4/57 R |

*Primary Examiner*—Richard E. Aegerter
*Assistant Examiner*—Stuart S. Levy
*Attorney, Agent, or Firm*—Jacque L. Meister

[57] ABSTRACT

A toilet tank flapper valve providing user selection of either a full or partial dispensing of the liquid contents of the tank. A novel ball-check valve particularly located in the flapper valve either obstructs water from entering or permits it to enter the buoyancy chamber of the flapper valve. When water is permitted to enter, a partial dispensing action results.

11 Claims, 13 Drawing Figures

Fig. 1
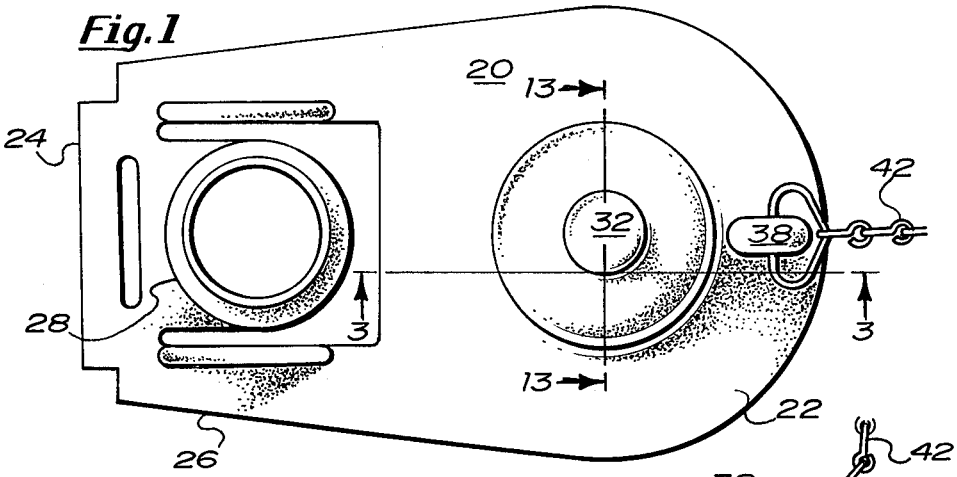
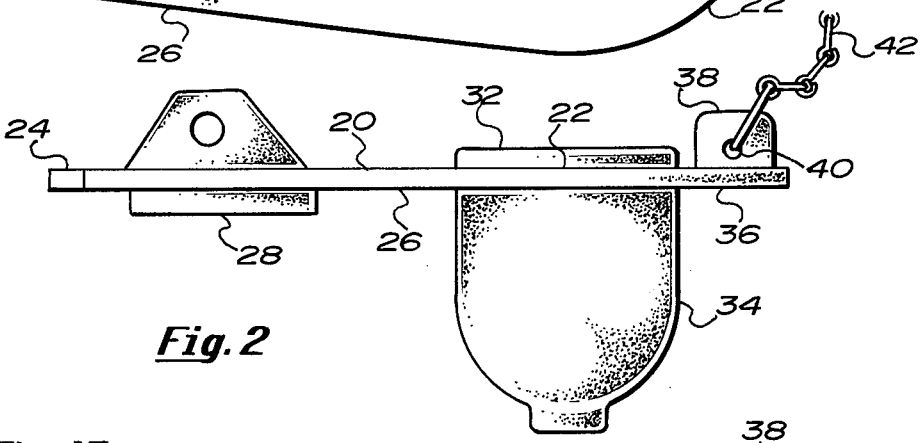
Fig. 2
Fig. 13
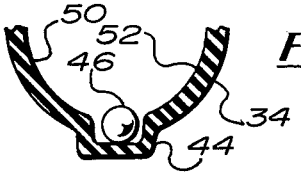
Fig. 3
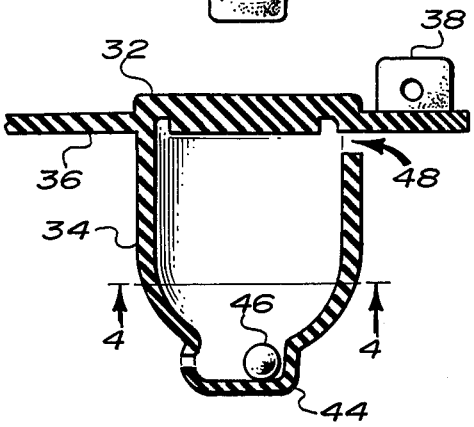
Fig. 8
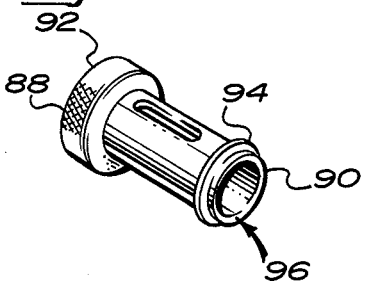
Fig. 7
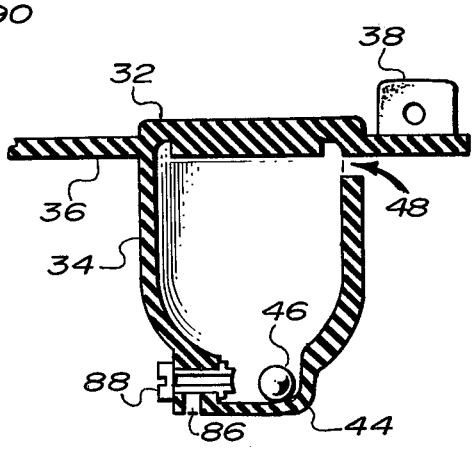

Fig. 4
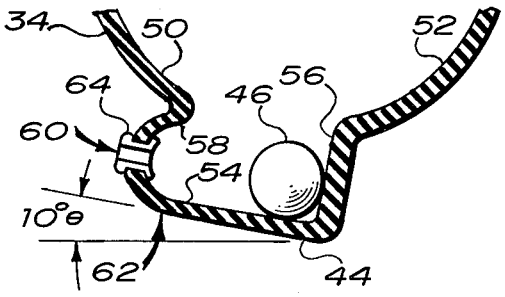
Fig. 5
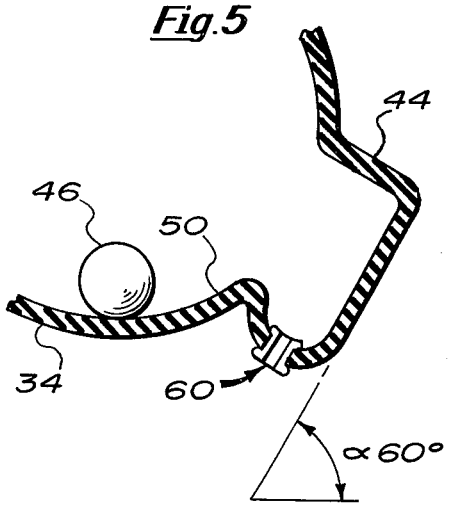
Fig. 6
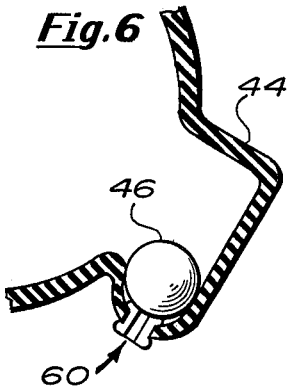
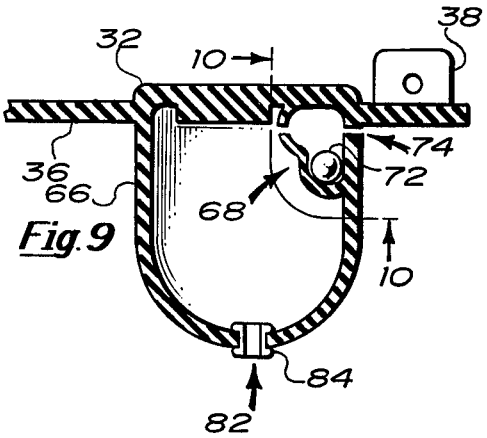
Fig. 9
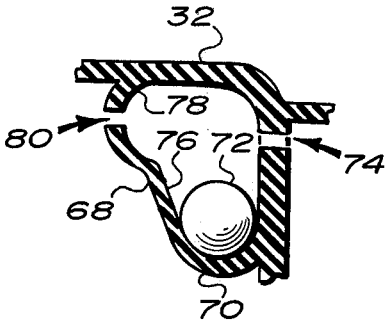
Fig. 10
Fig. 11
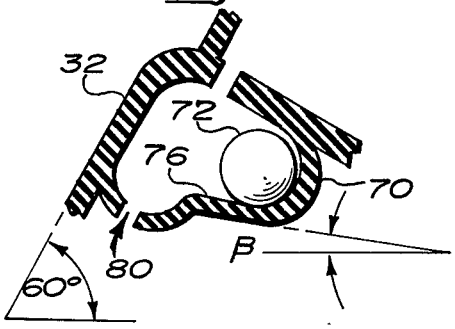
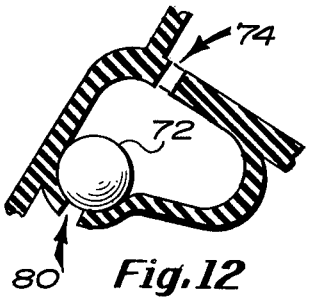
Fig. 12

FLAPPER FLUSH VALVE

BACKGROUND OF THE INVENTION

This invention relates to flapper type valve closures for toilet tanks generally; and, in particular, to a flapper valve containing a novel internal ball check valve that allows the user to select whether the entire tank volume shall be emptied or, a preselected smaller volume.

The prior art discloses numerous types and variations of flapper flush valves. The majority of these prior art valves are constructed of a flexible elastomer to provide a hinge action and have a flat sealing ring area surrounding a hollow buoyancy chamber. The valves are opened by a chain and, once opened, remain open until the liquid level in the tank drops to a level approximately that of the buoyant chamber. From that point on, the valve with its flat sealing ring drops with the falling water level until the sealing ring contacts and closes the tank water outlet tube. These valves have proven extremely useful in that they are inherently trouble-free over long periods of use. However, these flapper valves have had at most a minimal control over the volume of water dispensed from the tank, such control as exists being entirely a function of the overall buoyancy of the chamber.

Since water is becoming or has become a resource to be conserved, it is desirable that it not be wasted and, one of the largest wasters of water is the toilet. A toilet flush tank contains different amounts of water depending on its design and the water level therein. However, most such tanks have a full capacity of between 5 and 8 gallons and essentially all of this volume is dispensed each time the toilet is flushed. This is wasteful since experimentally it has been determined that much lower volumes of dispensed water can be used in toilets to dispose of liquid wastes as compared to that needed to effectively dispose of solid wastes. Thus, if were possible to preselect a water action that dispenses, say a half-tank full, it would be possible to reduce the water consumption of the average residential toilet by between 10 and 20 thousand gallons of water per year. Concomitantly, of course, there is an equal reduction in the volume of sewage to be processed with further savings from this as well. However, in toilet tanks having a relatively constant full water level and normal discharge valves such as the prior art flapper valves, it has not been possible to simply select and control the water dispensing action so that either a full tank or a preselected smaller volume are dispensed.

SUMMARY OF THE INVENTION

A principal object of the invention is to provide a new and improved flapper type toilet tank valve that permits a user to select between the discharge of either the full toilet tank or a preselected smaller volume. This object is achieved by a novel ball check valve incorporated in the buoyance chamber of the flapper valve.

Still another object of the invention is to provide a new and improved flapper type toilet tank valve having an integral ball check valve therein which allows for user selection of water conservation flushes where only about one-half of the tank volume is discharged. This object is achieved by a novel construction of the ball check valve which permits the user to select between the check valves use or non-use.

The foregoing and other objects of the invention are achieved by incorporating an air vent hole at the portion of the buoyancy chamber that is highest when the valve is actuated and, by incorporating a user controlled check valve to control water entering the chamber and, indirectly, to control the air venting action. When the check valve is closed the entire toilet tank volume is dispensed before the flapper valve recloses the tank outlet. When the check valve is opened, water enters the buoyancy chamber during the water dispensing action with the result that buoyancy is decreased and the valve closed before the entire tank volume has been dispensed. The nature of the invention and its several features and objects will however appear more fully from the following description made in connection with the accompanying drawings.

DESCRIPTION OF THE DRAWINGS

FIG. 1 is a top view of the flapper valve of the invention;

FIG. 2 is a side view of the flapper valve;

FIG. 3 is a vertical section of the valve taken at 3—3 in FIG. 1;

FIGS. 4–6 are partial enlarged sections taken at 4—4 in FIG. 3 to illustrate check valve action;

FIG. 7 is an enlarged portion of a flapper valve which achieves a completely adjustable metering action.

FIG. 8 is a detail of FIG. 7;

FIG. 9 is another section view similar to FIG. 3, but showing an alternate construction of the inventive flapper valve;

FIGS. 10–12 are partial enlarged sections taken at 10—10 in FIG. 9 and illustrates the check valve action of that embodiment; and FIG. 13 is a partial cross-section taken at 13—13 in FIG. 1.

DESCRIPTION OF THE PREFERRED EMBODIMENTS

FIGS. 1 and 2 are respectively top and side views of the preferred embodiment of the flapper valve of the invention which is generally designated as 20 and which is formed or molded as a single unitary construction of an elastomer such as rubber but which in any event is flexible and resilient. The valve 20 comprises a closure portion 22, and attachment portion 24 and intermediate these two portions, a flexible hinge portion 26. As shown, the attachment portion 24 comprises a simple sleeve 28 for assembly over the overflow tube of a toilet tank. While this fastening means has been shown for illustration purposes as a sleeve, any suitable fastening means of the art may be used in the practice of the invention, the fastening means not being a part of the invention. As best shown in FIG. 1, the intermediate hinge portion 26 is provided with two spaced-apart flexible side hinge arms 30 which connect the closure portion 22 to the attachment portion 24. In other embodiments a single hinge arm has been used.

The closure portion 22 has a disc-like raised portion 32 on its top surface and depending beneath it a buoyancy chamber comprising a hollow float bulb 34 which contains the check valve of the invention. The preferred constructions and mode of operation of the check valve are shown in FIGS. 3–10. The float bulb 34 serves in a conventional manner as a flotation or buoyancy chamber but, as set forth below, important variations are incorporated which permit achieving the objects of the invention. The underside of the closure portion 22 of the body surrounding the float bulb is smooth and unobstructed and said surrounding surface forms a sealing area 36 so that when the float bulb is received in the usual flush valve fitting of a conventional toilet flush tank the sealing area 36 will engage the valve fitting to seal it off to close the outlet of water from the flush tank. Projecting upwardly from the closure portion 22 and formed integrally therwith is a tab 38 having an opening 40 to which is attached a flexible chain 42 for lifting the closure from the closed position by means of the usual handle operation.

Thus far there has been described a quite conventional toilet tank flapper valve with the exception of the ball check valve incorporated in the float bulb. It is this check valve with respect to both its form, location and function and, a modification of the float bulb, to which the invention is directed and which permits the user to select between a full and partial dispensing of the tank water supply. The preferred form of the float bulb modification and of the ball check valve therein are shown in FIG. 3 and the operation of this check valve is shown in and described in connection with FIGS. 4–6 and 13.

The ball check valve comprises an especially formed body 44 positioned beneath and having its chamber open to the interior of the float bulb 34. Positioned interior of the float bulb 34 is a ball 46 which may be received in valve body 44 but which is not retained in that body. An air vent hole 48 is located in the float bulb at the location that is highest when the flapper valve is raised to effect water dispensing for the toilet flushing action. The check valve is shown in FIGS. 4 and 13 in the position it assumes when the flapper valve is sealing the tank outlet. As there shown the interior walls 50 and 52 of the float bulb on either side of the valve body are inclined downwardly toward the valve body to insure that ball 46 drops to the bottom surface 54 of valve body 44. As shown in FIG. 13, valve body 44 is wide enough to receive ball 46, a nominal minimum clearance of 0.015 to 0.032 inches haven proven satisfactory. Bottom surface 54 is itself inclined at a slight angle $\Theta$ with respect to horizontal to cause ball 46 to assume an at-rest position against wall 56 of the valve body. This inclination is nominally 10° although smaller and larger angles can be used. Ten degrees was chosen as the smallest angle in a resilient material that would reliably insure the ball resting against wall 56.

Increased angles can be used but as the discussion below brings out, too large an angle reduces the reliability of the partial flushing action.

A semi-spherical valve seat 58 adapted to receive ball 46 is formed in valve body 44 at the end opposite wall 56. An orifice 60 is incorporated in the seat. As shown, the orifice 60 is approximately centered on the center line of ball 46. However, in locations where algae or sediment can be deposited in the valve body, a preferred construction relocates orifice 60 to the point indicated by arrow 62. In either event, the orifice 60 should release all or substantially all of any water which may enter float bulb 34.

Operation of the check valve during a partial water dispensing action is shown in FIG. 5 and for a complete dispensing of the contents in FIG. 6. In FIG. 5 ball 46 is shown at rest on interior wall 50 of float bulb 34 and the flapper valve is in its raised or water dispensing position. Angle $\alpha$ which is the angle of inclination when the valve is open is ordinarily on the order of 60° from the horizontal position of FIG. 4. With ball 46 as shown in FIG. 5, orifice 60 is unobstructed and water is free to enter float bulb 34. The water entering the bulb causes air to be vented from hole 48, reducing buoyancy. This causes the flapper valve to close sooner resulting in only a partial dispensing of tank contents. With ball 46 positioned in seat 58 and closing orifice 60, with the flapper valve in its raised or water dispensing position, operation of the flapper valve is substantially identical to that of a prior art valve. Buoyancy does not change and a full tank of water is dispensed.

User selection of a partial or complete dispensing action is simplicity itself. If the tank actuating handle which is connected to the flapper valve is depressed gently, the check valve operates as shown in FIG. 6 and a full tank of water is dispensed. If user handle action is vigorous, ball 46 is projected to the position shown in FIG. 5 and a partial dispensing action results.

In order to achieve the desired results, it has been determined that ball 46 should be a 5/16 inch diameter stainless steel ball. If the ball is much smaller, water pressure tends to force it out of the position shown in FIG. 6. If the ball is larger, its weight begins to affect the buoyancy of float bulb 34. The size of orifice 60 and vent hole 48 must be maintained at the proper sizes to establish and control the partial flushing action. Ordinarily air vent hole 48 is maintained at 0.125 inch diameter and the diameter of orifice 60 is varied to control the amount of water dispensed in the partial flushing actions. For most applications, the size of orifice 60 is varied between 0.09375 inches and 0.1875 inches, the larger the size the smaller the amount of water being dispensed. As a practical matter, the orifice 60 is formed with a 0.1875 inch opening and smaller orifices achieved through the use of snap-in inserts 64 which have the selected smaller size orifice.

An alternate manner of adjusting the partial dispensing action is shown in FIGS. 7 and 8. FIG. 7 is an enlarged detail of the valve body portion of the float bulb and shows detail generally similar to that shown in FIGS. 3–6. However, the position of the water inlet orifice 86 has been revised to permit it being incrementally closed. The inlet area of the valve body has been adapted to receive metering member 88 and orifice 80 made a simple hole nominally 0.1875 inch diameter. Metering member 88 is shown in FIG. 8 and is comprised of a slotted tubular member 90, a knurled head 92 and a retaining ridge 94. The slot 96 extends the length of tubular member 90 and when aligned with orifice 86 leaves that opening unobstructed. Turning of metering member 88 selectively obstructs orifice 86 to achieve variable dispensing action.

An alternate construction of the inventive flapper valve is shown in FIG. 9 with its operation and construction shown in enlarged detail in FIGS. 10-12. The basic flapper valve construction is identical to that shown and described in conjunction with FIGS. 1 and 2; the alternate construction being in the area of the float bulb 66 and check valve 68. In FIGS. 9–12 check valve 68 comprises an especially formed check valve body 70 which is positioned entirely within float bulb 66. Positioned interior of the valve body 70 is a ball 72 free to move within the confines of the valve body. An air vent hole 4 is located in the float bulb outer wall at the location that is highest when the flapper valve is raised to effect water dispensing for the toilet flushing action. The air vent hole 74 communicates with the interior of valve body 70.

In FIG. 10, the check valve is shown in the position it assumes when the flapper valve is sealing the tank outlet. As there shown the wall 76 of valve body 70 is inclined downwardly to insure that ball 72 assumes the position shown. A semi-spherical valve seat 78 adapted to receive ball 72 is formed in valve body 70. An orifice 80 is incorporated in float bulb 66. Operation of the check valve during a partial water dispensing action is shown in FIG. 9 and for a complete dispensing action is shown in FIG. 10.

In FIG. 11, ball 72 is shown at rest in the interior of valve body 70 in a position that does not obstruct orifice 80. In FIG. 11 the flapper valve is shown in its raised or water dispensing position. In this position, the closure portion of the valve body is inclined upward from horizontal at an angle of approximately 60° and wall 76 is inclined at an angle $\beta$ that is analogous to angle $\alpha$ of FIG. 4 and which is of the same order of magnitude and for the same purpose. With ball 72 in the position shown in FIG. 11 and orifice 80 unobstructed, water is free to enter the float bulb 66 through inlet 82 and air is vented out through vent 74. This reduces float bulb buoyancy causing the flapper valve to close sooner than if orifice 80 were sealed and, results in the partial dispensing of tank contents. With ball 72 positioned in seal 78 and closing orifice 80 and with the flapper valve in its raised water dispensing position, as shown in FIG. 10, operation of the flapper valve is akin to that of the prior art. Buoyancy of the float bulb 66 does not change during the dispensing action and a full tank of water is dispensed.

As with the embodiment of FIGS. 3–6, selection of a partial or complete dispensing action depends on the vigorousness of the user in actuating the control handle. However, the action is opposite to that of the other embodiment. Here a gentle action results in a partial dispensing action and a vigorous action seats ball 72 in seat 78 resulting in a complete dispensing action.

In order to achieve the desired results, ball 72 is preferably a ¼ inch stainless steel ball, orifice 80 is 0.093125 inch in diameter, vent hole 74 is 0.1875 inch diameter and water inlet 82 is 0.125 inch diameter. Variation in the amount of water dispensed is achieved by inserting a selected snap-in piece 84 in inlet opening 82. Each of the snap-ins 84 has a smaller opening than that of basic inlet 82.

The embodiment of FIGS. 4–8 is preferred because it is simpler to construct than that of the embodiment of FIGS. 9–12. However, either embodiment functions to permit user selection of full or partial tank dispensing action. Also, while each of the embodiments described employs a ball in a ball check valve body, it is possible to dispense with the ball completely. In such an instance, the inventive flapper valve at all times reduced the water dispensed in accord with the setting or diameter of the water inlet metering orifice. Further, while specific constructions have been shown and described, it is understood that other modifications may be made in the design and arrangement of the parts without departing from the spirit of the invention.

What is claimed is:

1. A flapper valve for use in a tank having a valve operating mechanism and a flapper valve sealable outlet fitting for the liquid in the tank, said flapper valve comprising an attachment portion means for connecting the flapper valve to the tank structure in a position that the valve will function, a buoyant closure portion means for selectively closing said tank outlet, said closure portion means comprising a capped sealing area for engaging said tank outlet fitting, a vented buoyant hollow float bulb having a liquid inlet opening, said float bulb means depending downwardly from said closure portion and interior of said sealing area, and a valve actuating tab for connecting said valve to said valve operating mechanism, an intermediate hinge portion means comprising flexible hinge arm means connected between said attachment portion means and said closure portion means, and ball check valve means connected to said float bulb means having an operator selectable ball position from outside said tank through use of said valve operating mechanism connected to said valve actuating tab whereby the venting of air from said float bulb is selectively controlled.

2. A flapper valve in accord with claim 1 wherein said vent in said hollow float bulb means pierces the wall of said float bulb means at the point that is highest when said flapper valve is raised to its tank outlet non-sealing position by said valve operating mechanism.

3. A flapper valve in accordance with claim 2 wherein said float bulb means further comprises water inlet means located near the bottom of said hollow float bulb when the flapper valve is sealing said tank outlet fitting whereby any water in said float bulb is free to drain therefrom.

4. A flapper valve in accord with claim 3 wherein said water inlet means further comprises means for selectively reducing its diameter.

5. A flapper valve in accordance with claim 3 wherein said check valve means comprises valve body means forming a chamber surrounding said vent and interior of said float bulb means, said valve body means having an orifice means forming a passageway between the interior of said valve body means and the interior of said float bulb means and valve seat means formed in said valve body surrounding said orifice means, and freely movable ball means positioned interior of said float bulb means and said valve body means and adapted to be received in said valve seat means to close said orifice means.

6. A flapper valve in accord with claim 5 wherein said orifice means is positioned at the end of said valve body means nearest said attachment portion.

7. A flapper valve in accord with claim 6 wherein the lowest side of said valve body means when said flapper valve is raised to its water dispensing position, is inclined downwardly away from said valve seat means whereby said movable ball can be retained in an orifice non-obstructing position with the flapper valve in said raised position.

8. A flapper valve for use in a tank having a flapper valve sealable outlet fitting for the liquid in the tank, said flapper valve comprising an attachment portion means for connecting the flapper valve to the tank structure in a position that the valve will function, a buoyant closure portion means for selectively closing said tank outlet, said closure portion means comprising, a capped sealing area for engaging said tank outlet fitting, a vented buoyant hollow float bulb having a liquid inlet opening, said float bulb means depending downwardly from said closure portion and interior of said sealing area, and a valve actuating tab for connecting said valve to a valve operating mechanism, an intermediate hinge portion means comprising flexible hinge arm means connected between said attachment portion means and said closure portion means, and ball check valve means connected to said float bulb means to selectively control by ball position the venting of air from said float bulb, said ball check valve means being positioned beneath said float bulb means and comprising valve body means having its chamber open to the interior of said float bulb and having an orifice means formed in one wall thereof with valve seat means surrounding said orifice means, and freely movable ball means positioned interior of said float bulb means and said valve body means and adapted to be received in said valve seat means to close said orifice means.

9. A flapper valve in accordance with claim 8 wherein said valve body means is aligned so that said orifice means is positioned at the end of said valve body means nearest said attachment portion and the bottom surface of said valve body is positioned at an angle $\Theta$ with respect to said capped sealing area.

10. A flapper valve in accord with claim 8 wherein the lowest side of said valve body means when said flapper valve is sealing said tank outlet fitting, is inclined downwardly away from said valve seat means and the interior walls of said float bulb means are inclined downwardly toward said valve body means whereby said ball means assumes an orifice means non-obstructing position when said tank outlet is sealed.

11. A flapper valve in accord with claim 8 further comprising snap-in insert means for said orifice means whereby the size of said orifice means may selectively be reduced.

* * * * *